US005792714A

United States Patent [19]

Schindler et al.

[11] Patent Number: 5,792,714

[45] Date of Patent: Aug. 11, 1998

[54] THERMOREGULATORY APPAREL

[76] Inventors: Jerry Schindler, 5571 Fallsbrook Trace, Acworth, Ga. 30101; Charles Perry Duncan, 36 Pine Knot Rd., Fayetteville, Ga. 30214

[21] Appl. No.: 754,691

[22] Filed: Nov. 21, 1996

Related U.S. Application Data

[60] Division of Ser. No. 481,874, Jun. 7, 1995, Pat. No. 5,636,380, which is a continuation-in-part of Ser. No. 239,590, May 9, 1994, abandoned.

[51] Int. Cl.[6] ..... D03D 3/00

[52] U.S. Cl. ..... 442/194; 2/69; 2/DIG. 1; 428/102; 428/193; 442/189; 442/239

[58] Field of Search ..... 428/102, 193; 442/239, 240, 338, 189, 194; 2/DIG. 1, 69

[56] References Cited

U.S. PATENT DOCUMENTS

| | | | |
|---|---|---|---|
| 3,801,422 | 4/1974 | Gorlach et al. . | |
| 4,675,009 | 6/1987 | Hymes et al. . | |
| 4,770,919 | 9/1988 | Tesch . | |
| 5,072,455 | 12/1991 | St. Ours . | |
| 5,131,100 | 7/1992 | Atwater et al. | 2/405 |
| 5,291,617 | 3/1994 | Moretz et al. | 2/400 |
| 5,382,223 | 1/1995 | Springs | 602/6 |
| 5,392,467 | 2/1995 | Moretz et al. | 2/400 |
| 5,402,540 | 4/1995 | Williams | 2/239 |
| 5,636,380 | 6/1997 | Schindler et al. | 2/69 |

*Primary Examiner*—James J. Bell
*Attorney, Agent, or Firm*—Fildes & Outland, P.C.

[57] ABSTRACT

Thermoregulatory apparel includes garments, for close-fitting skin-contacting wear having, in preferred embodiments, a base fabric of Coolmax$^{cm}$ high moisture evaporation fabric having one or more insulating panels of Thermax$^{cm}$ or Thermastat$^{cm}$ hollow core fiber fabric having moisture wicking capability and applied to the inner side of the garment for skin contact at selected areas of the body where muscle protection is desired. The insulating panels maintain body heat in the protected muscles while evaporative cooling is encouraged by wicking of perspiration away from the body for evaporation from the outer Coolmax$^{cm}$ fabric. Alternative fabric choices and various garment combinations may be utilized.

8 Claims, 2 Drawing Sheets

THERMOREGULATORY APPAREL

CROSS-REFERENCE TO RELATED APPLICATIONS

This application is a division of application Ser. No. 08/481,874, filed Jun. 7, 1995 now U.S. Pat. No. 5,636,380 which is a continuation-in-part of U. S. patent application Ser. No. 08/239,590 filed May 9, 1994 now abandoned.

FIELD OF THE INVENTION

This invention relates to thermoregulatory apparel and in particular to close fitting skin contacting garments for the regulation of body temperature.

BACKGROUND OF THE INVENTION

It is known in the art that human performance, in work or athletic competition, is dependent upon maximal muscle efficiency. Muscles function most efficiently in an optimized cellular environment which is defined as:

1) Homeothermic temperature—37° C.±1° C.
2) Homeostatic Ph range—7.4±0.2
3) Adequate/Abundant Energy Sources (glycogen/glucose)
4) Adequate/Abundant Oxygen Sources
5) Maximized Blood Circulation (to bring in nutrients, oxygen; and remove waste products—lactic acids and $CO_2$)

During human work (or athletic performance) muscle metabolism creates a tremendous heat load which must be dissipated by the human thermoregulatory system.

The skin, through the production and evaporation of perspiration, dissipates this heat load. Radiation, conduction, and convection contribute to this heat dissipation. However, in the active athlete, 80% of this heat dissipation is accomplished by the evaporation, at the skin level, of perspiration.

Humans (and their muscles) function best in a homeothermic state, (37° C.±1° C.). Thus the proper management of this "heat load of metabolism" assumes a high priority in the circulatory physiologic response of athletes in competition (or in high-intensity workers).

The circulation (blood flow) eventually finds itself with two high demand requirements:

1) Carry blood flow to the skin to dissipate excess heat of muscle metabolism.
2) Carry blood flow to the muscle to replenish glycogen/glucose stores, oxygen, and remove acidic waste products (Lactic acid and $CO_2$).

A competition then develops between the skin and muscle for blood flow in the high performance athlete or intense worker.

SUMMARY OF THE INVENTION

The present invention provides thermoregulatory apparel in the form of garments including diverse panels which enhance the skins ability to dissipate or retain heat as necessary to maintain a body temperature or homeothermic muscle environment of 37° C.±1° C. The garments may include various apparel items applicable for use on different parts of the body and include, but are not limited to, pants, shorts, stockings, body suits, wraps, braces, pads, supports, socks, leggings, sleeves, shirts, hats, gloves and the like.

Each garment includes a combination of heat dissipation panels and heat retention panels which are to be worn in contact with the skin. The heat dissipation panels increase the skin's ability to evaporate perspiration by wicking moisture from the skin to an outer portion of the garment. In preferred embodiments, the evaporation of perspiration, and thus cooling, is enhanced by increasing the fiber surface area which is available in the garment for exposure of the perspiration to the air so that evaporation occurs more quickly. Thus the garment does not become soaked and prevent the circulation of air through its fibers.

The heat retention panels in each garment increase the skin's ability to maintain and develop heat in major muscle groups of the body. These heat retention panels reflect heat, or lessen heat loss, and are placed to cover superficial major muscle groups prone to injury. Preferably, these heat retaining panels utilize fibers of hollow construction which trap air within each fiber for insulation of the heat retaining panel. These fibers are, preferably, also configured to wick moisture to the exterior of the insulating panels and, in some cases, to adjacent cooling panels for rapid moisture elimination.

The unique interaction of cooling panels and heat retaining panels in the same garment is the essence of Thermoregulatory Apparel. By design, such a garment enhances the skin's efforts to:

1) Evaporate perspiration and cool the body and/or
2) Retain heat from selected body portions and wick moisture away for rapid evaporation, thus keeping the garment dry and warm.

Thermoregulatory Apparel potentiates and improves the skin's efforts to maintain a steady thermoregulatory, homeothermic muscle environment of 37° C.±1° C. Either cooling or heat retention is improved, depending on the variation from the desired 37° C. As a result, the human thermoregulatory system becomes more efficient in managing environmental temperature changes. Greater temperature variances (hot or cold) can be managed with less stress on the thermoregulatory system, less skin blood flow, and less perspiration production. This decreases dehydration, allows more blood flow to be directed to active muscle groups, and enhances performance. Injury rates are lessened and post-activity recovery times are shortened. Thermoregulatory Apparel has positively affected the competition between skin and muscle for blood flow in the maximally stressed athlete or worker. In addition, areas prone to injury can be cooled or heated, as required, to lessen soft tissue injury rates.

The invention herein drastically reduces muscle injury and encourages the healing process through the material composition which is used to make apparel which causes the heat generated by the muscle to retain and to be reflected back (vasodilation) into the muscle to maintain an optimal level of heat and oxygenation and to reduce the rapid cooling (vasoconstriction—which restricts the capillaries and reduces the oxygen causing the spindles and fibers to shorten which results in the damaging effects mentioned above) and reheating which may lead to muscle injury.

An added benefit relates to the energy producing results of this effect. Depending upon the type and intensity of physical exertion, one will observe different levels of heat production. The body will transfer the energy caused via the cellular metabolism to the skeleton, making movement possible. During, the aforementioned, elevation of body core temperature occurs. This resulting increase of body core temperature and the maintenance of the higher body core temperature also causes a condition which will improve the kinetic output due to a faster rate of metabolism. This effect is a result of the thermoregulatory apparel. The biochemical response at the cellular level of the muscle unit will thus become lower in its viscosity. This unique effect is a direct result of the thermoregulatory apparel and is completely unique from any other product available. This in turn will allow for reduction in resistance and improvement in the muscle's ability to contract along with the increased temperature. The benefits described herein are uniquely attributable to the thermoregulatory apparel which is the subject of this patent application.

The thermoregulatory apparel isolates the long musculatendon units in a state of vasodilation which by its properties cause an increase in oxygen delivery. The capillaries will not be cut off due to vasoconstriction caused via the sweat response. More oxygen is emitted from hemoglobin and delivered into the cellular level of the muscle. There will exist less constriction of the spindles and fibers of the muscle and greater elasticity. This unique result is the performance enhancement property of the thermoregulatory apparel.

The result is: a reduction in muscle injuries such as sprains, strains, and pulls; an improved environment for the healing process; and greater efficiency of performance output.

In referring to the drawings, it should be understood that the broad concept involves use of a dual fabric garment to control body temperature. Such garments may be of any useful type, including shirts, compression shorts, socks, leggings, hats, gloves, pants and so forth, which may be useful in accomplishing the purpose of retaining controlled heat in commonly injured or stressed areas, such as hamstrings and gluteal muscles and quadriceps, and providing maximum cooling for other areas of the body. The drawings therefore illustrate only examples of such garments which are subject to changes in their details and configurations of the various panels to accomplish the desired purposes.

These and other features and advantages of the invention will be more fully understood from the following description of certain exemplary embodiments of the invention taken together with the accompanying drawings.

DETAILED DESCRIPTION OF THE INVENTION

Figure 1:
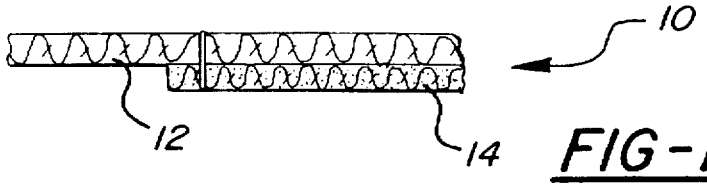
FIG. 1 is a cross-sectional view of a cloth panel assembly including cooling and insulating fabrics according to the invention.

Referring first to FIG. 1 of the drawings in detail, numeral 10 generally indicates a thermoregulatory cloth material which includes a base layer of fabric 12 made of a polyester fiber blend which enhances evaporation of perspiration and wicking. Examples of polyester fiber are found in clothing made with fabric certified with the name Coolmax$^{cm}$ by the Dupont Company. Cloth 10 additionally includes at least one insulating panel 14, made from a heat retaining polyester fiber blend and internally applied in a garment over the areas where controlled heat retention is desired. Examples of fiber for use in such insulating panels may be found in fabrics certified by the Dupont Company with the names Thermax$^{cm}$ and Thermastat$^{cm}$. Such fibers have hollow cores which provide insulating air space within the fibers. The Thermastat$^{cm}$ fiber is additionally configured to form linearly extending groove-like passages that promote wicking of perspiration along the fiber away from the body. The insulating panel 14 is preferably sewn onto the base fabric layer 12 on the inner side so that it contacts the skin of the body directly. However, if desired, an insulating panel could be edge-attached to a base layer without forming a double cloth layer as in the preferred embodiment.

While the materials mentioned above are preferred for thermoregulatory cloth according to the invention, it would be possible, if desired, to make the base fabric and insulating panel from other materials. For example, the base cloth could in addition to polyester be formed of cotton, lycra, spandex, rayon or even nylon, although these are not as effective in removing heat from the body as the Coolmax$^{cm}$ polyester material. In like manner, other materials might be used for the insulating panels, although with less effective results. Obviously, if improved fibers or manners of making the cloth for the base layer and insulating panels are developed, these improved materials and weaves could be substituted for those disclosed in the preferred embodiment of this invention.

Figure 2:
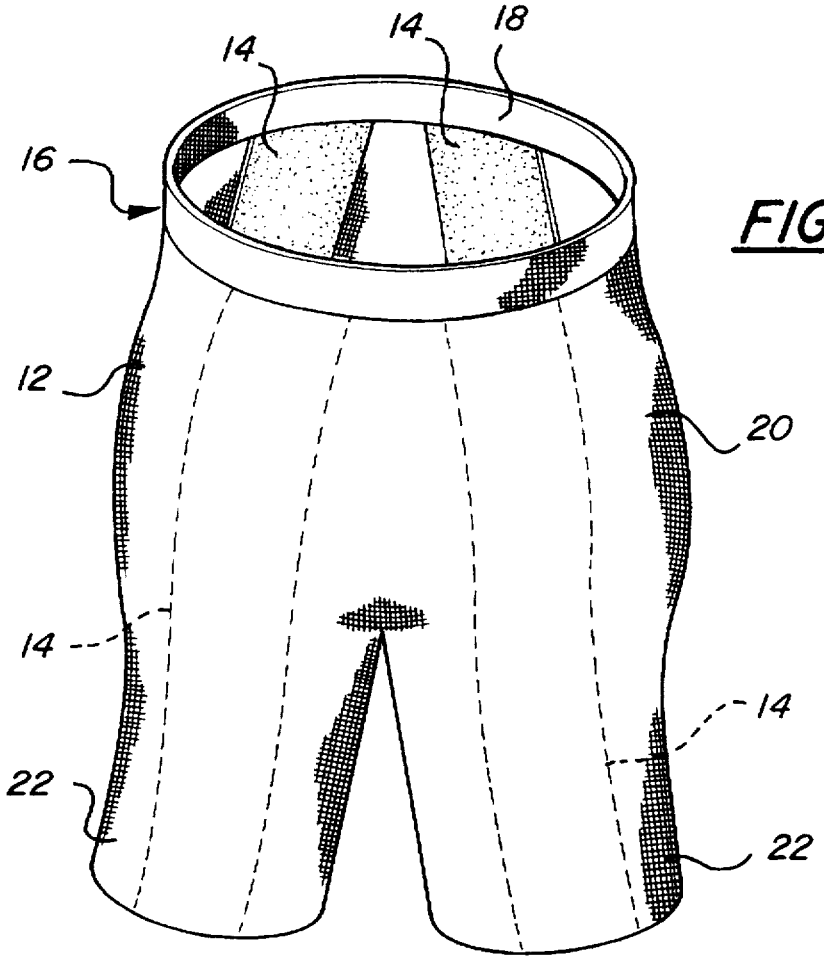
FIG. 2 is a pictorial view of a compression shorts garment for athletes according to the invention.

Referring now to FIG. 2, there is shown an example of compression shorts for athletes, and the like, generally indicated by numeral 16. The shorts are formed with a waistband 18 sewn to a garment having the base fabric layer 12 formed with a lower body enclosing portion 20 and a pair of legs 22. Preferably the legs will be long enough to extend down to just above the knee of the wearer in order to obtain the most effective results from the garment. However, shorter length compression shorts may be of value and are to be included within the scope of the invention. The shorts 16 further include insulating panels 14 sewn, or otherwise attached, to the interior of the base fabric 12. Panels 14 extend generally from the waistband 18 to the lower ends of the legs 22 and along the rear portions of the body and legs. Optionally, similar panels can be applied to the front portions of the legs and lower body. The shapes of the panels may be varied as desired to cause controlled heat retention on those portions of the body where muscles and related stressed structure are located which it is desired to protect by allowing faster warmup and increased blood flow to these areas during exercise or activity and thereafter while cooling off.

Figure 3:
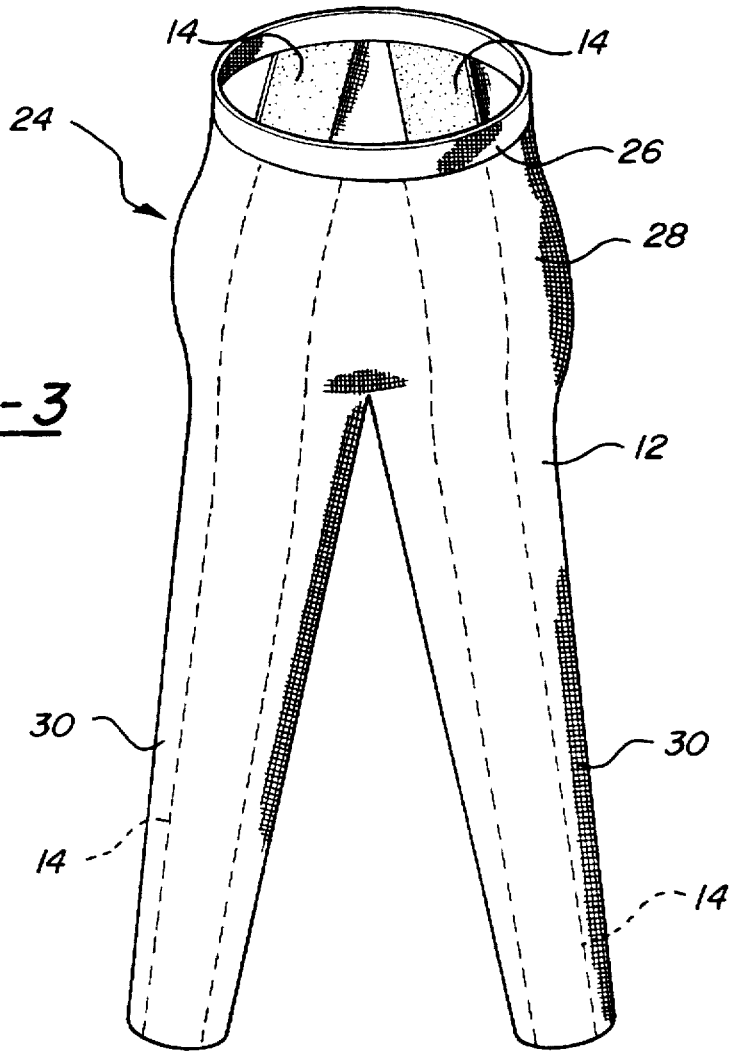
FIG. 3 is a pictorial view of a compression slacks garment with insulating panels according to the invention.

Referring to FIG. 3, there is shown a pair of slacks or pants 24 having a waistband 26 attached to a lower body enclosing portion 28 connected with full-length legs 30, the portions 28 and 30 being formed completely from Coolmax$^{cm}$ polyester fabric 12. Within this garment fabric are formed insulating panels 14 extending from the waistband 26 to the bottom of the full-length legs in a manner similar to that described for the compression shorts of FIG. 2.

Figure 4:
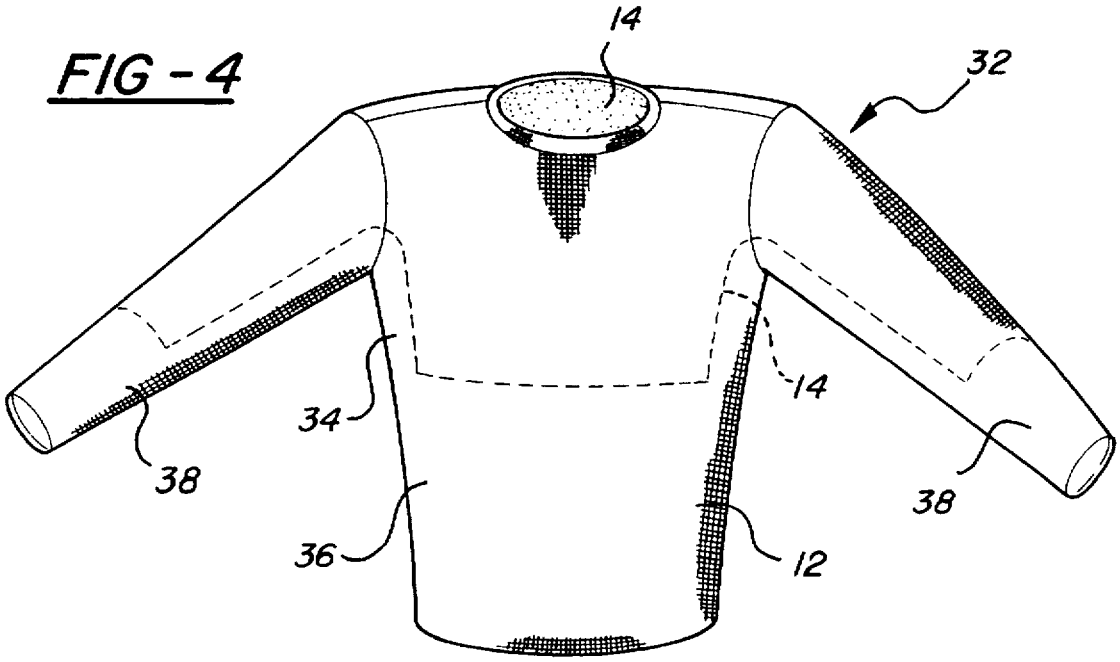
FIG. 4 is a pictorial view of a close fitting shirt formed with an insulating panel according to the invention.

FIG. 4 illustrates a close fitting shirt 32 which is again formed fully of Coolmax$^{cm}$ fabric 12 and includes upper and lower body portions 34, 36 connected with arms 38. Within this garment shell, an insulating panel 14 is sewn which extends over the front and rear portions of the upper body portion of the garment and the upper portions of the arms down to about the elbows. The lower portions of the arms are left free of the insulating panel 14 to allow rapid cooling and evaporation of perspiration in the under arm area as well as along the sides of the upper body portion.

Figure 5:
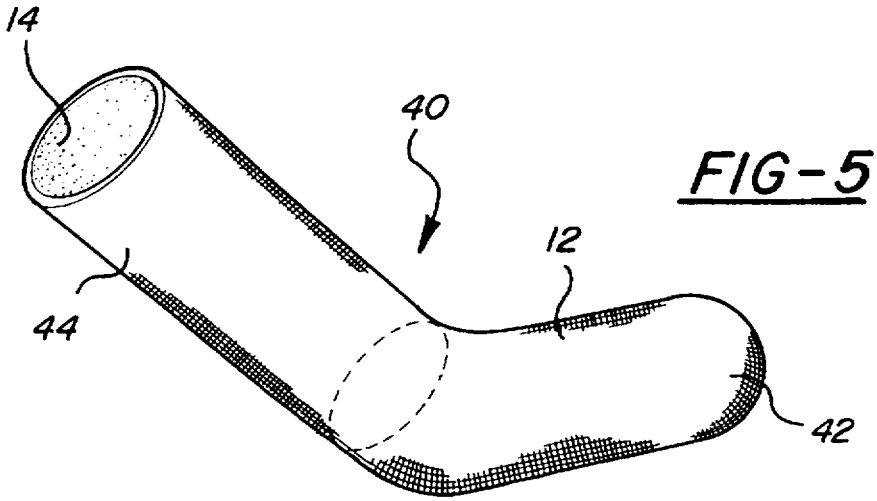
FIG. 5 is a pictorial view illustrating one of a pair of socks having an insulating panel in the leg portion according to the invention.

Referring now to FIG. 5, there is shown a sock 40 having a foot portion 42 and a leg portion 44. As in the other garments, the complete sock 42 may be formed with an exterior layer of the base fabric 12 while the leg portion from the ankle upward is formed with an interior layer of the insulating panel 14 material. The combination controls the temperature for heat rejection from the easily injured ankle and leg muscular areas while the foot portion is made from the Coolmax$^{cm}$ material which maximizes evaporation of perspiration and cooling. Alternatively, the leg portion of the sock may be made only from the insulating panel material, such as Thermax$^{cm}$ and Thermastat$^{cm}$ fabric materials, which may be sewn to the foot portion 42 made of Coolmax$^{cm}$ fabric.

In use, a thermoregulatory garment made of a dual fabric cloth, such as cloth 10, helps maintain the desired body temperature under all conditions. When the rate of perspiration is high, as during high stress bodily activity, the insulating panels carry the moisture to the Coolmax$^{cm}$ fabric so that the protected muscle areas are adequately cooled and the fabric remains open to air flow. When activity is reduced and perspiration slows or stops, the insulating panels maintain body heat of the protected muscles to prevent their rapid cooling. In areas of a garment unprotected by insulating panels, the Coolmax$^{cm}$ fabric provides maximum cooling by evaporation of perspiration when activity is high and cooling is naturally reduced during periods of low activity. The high wicking ability of Coolmax$^{cm}$ fabrics and the good wicking ability of Thermax$^{cm}$ and Thermostat$^{cm}$ fabrics make them ideal for use in thermoregulatory garments in accordance with the invention.

While the invention has been described by reference to various specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. Thermoregulatory apparel for body heat control including a garment adapted for close-fitting skin-contacting wear upon a portion of a human body, said garment comprising:

a base fabric made of heat dissipating fiber generating substantial moisture evaporation from skin contacted by said fabric; and an insulating panel attached to the base fabric and forming an inner side of a portion of the garment for wearing against the skin, said panel made of a hollow core heat insulating fiber for retaining body heat in the area of the body contacted by the panel; said panel being applied to a portion of the garment for covering superficial major muscle groups of the body prone to injury to maintain an elevated muscle temperature whereby the garment prevents excessive cooling during periods of inactivity of the muscles covered by said insulating panel while rapid cooling is provided through other portions of the garment.

2. The invention as in claim 1 wherein said base fabric is selected from the group consisting of nylon, polyester, and cotton.

3. The invention as in claim 1 wherein said insulating panel is made from a hollow core fiber.

4. Thermoregulatory apparel for body heat control including a garment adapted for close-fitting skin-contacting wear upon a portion of a human body, said garment comprising:

a base fabric made of heat dissipating fiber generating substantial moisture evaporation from skin contacted by said fabric; and an insulating panel attached to an inner side of the base fabric for wearing against the skin, said panel made of a hollow core heat insulating fiber for retaining body heat in the area of the body contacted by the panel; said panel being applied to a portion of the garment for covering superficial major muscle groups of the body prone to injury to maintain an elevated muscle temperature whereby the garment prevents excessive cooling during periods of inactivity of the muscles covered by said insulating panel while rapid cooling is provided through other portions of the garment.

5. The invention as in claim 4 wherein the base fabric fiber is polyester and has a configuration including at least one longitudinal channel that provides wicking of moisture away from adjacent skin to enhance evaporation.

6. The invention as in claim 4 wherein the hollow core fiber is configured to provide wicking of moisture away from adjacent skin to enhance evaporation.

7. The invention as in claim 4 wherein said base fabric is selected from the group consisting of nylon, polyester, and cotton.

8. The invention as in claim 4 wherein said insulating panel is made from a hollow core fiber.

* * * * *